US006904850B2

(12) United States Patent
Chang et al.

(10) Patent No.: US 6,904,850 B2
(45) Date of Patent: Jun. 14, 2005

(54) ANIMAL TREATMENT SYSTEM AND METHOD THEREOF

(76) Inventors: Ting-Ting Chang, No. 1017, Jen Ai Village, Jen Te Country, Tainan County (TW); Yu-Ting Chang, 1017, Jen Ai Village, Jen Te Country, Tainan County (TW); Hsiu-Ting Chang, No. 1017, Jen Ai Village, Jen Te Country, Tainan County (TW)

( * ) Notice: Subject to any disclaimer, the term of this patent is extended or adjusted under 35 U.S.C. 154(b) by 0 days.

(21) Appl. No.: 10/464,464

(22) Filed: Jun. 19, 2003

(65) Prior Publication Data

US 2004/0255830 A1 Dec. 23, 2004

(51) Int. Cl.[7] ..... F23B 7/00; F23G 5/02

(52) U.S. Cl. ..... 110/342; 110/346; 110/222; 110/259; 110/233

(58) Field of Search ..... 110/222, 259, 110/225, 235, 233, 194, 346, 342, 228, 219; 432/52; 210/175, 805; 452/173, 99

(56) References Cited

U.S. PATENT DOCUMENTS 4,133,273 A * 1/1979 Glennon ..... 110/346
4,211,174 A * 7/1980 Martin et al. ..... 110/263
4,253,405 A * 3/1981 Cottrell et al. ..... 110/222
4,668,391 A * 5/1987 Ottens ..... 210/181
5,339,752 A * 8/1994 Lewis ..... 110/194
5,799,597 A * 9/1998 Kaehr ..... 110/346
6,055,917 A * 5/2000 Shortnacy ..... 110/346
2003/0094422 A1 * 5/2003 Perkins et al. ..... 210/764

* cited by examiner

*Primary Examiner*—Kenneth Rinehart
(74) *Attorney, Agent, or Firm*—Bacon & Thomas PLLC

(57) ABSTRACT

The present invention relates to an innovative treatment system with a large capacity of 4,000 kg to 32,000 kg /per 8 hours up to 24 hours, and an animal incinerator is of the largest capacity all over the world at the present time. The present invention, comprising assemblable and movable devices that can be moved to any location needed, provides special functions: as carcasses be fed and dismembered automatically and continuously before incinerating, solids and liquids thereof being separated automatically, wherein the liquids can be reused after being evaporated and cooled, the solids be conveyed into the combustion chamber for incinerating, and combustible materials be kept moving, stirring and burning automatically in the furnace. The incinerator is equipped with scrubbers, shifters and a conveyor in the chamber having an automatic ash withdrawal. All systems described above conform to legal environmental regulations and fully meet environmental requirements.

11 Claims, 4 Drawing Sheets

| |
|---|
| FIGURE 1 |
| FIGURE 1A |
| FIGURE 1B |

ANIMAL TREATMENT SYSTEM AND METHOD THEREOF

BACKGROUND OF THE INVENTION

1. Field of the Invention

The present invention, comprising automatic assemblable and movable devices that can be moved to any location needed, relates to a system for animal carcass treatment, particularly an automatic system for animal carcass treatment with large processing capacity of 4,000 to 32,000 KGs per eight hours up to 24 hours, wherein a continuous mode of feeding is used and the incineration is distributed with a dynamic mode by conveying the solids that have been dismembered into 4" wide and 8" long chunks (e.g., a full-grown cow) within 3 minutes, bone-crushed and separated from liquids and in the meantime continuously proceeding with the incineration (at 900° C.–1,000° C.), while the sewage water is treated and recycled for further use, and the waste gas generated from the incineration further is treated with burning at higher temperature (1,100° C.) in the secondary combustion chamber, making the waste gas non-toxic by having it burned prior to exhaustion, thus complying with environmental protection standards so as not to pollute the environment, while effectively increasing the efficiency of the incineration and lowering the cost.

2. Description of Related Art

Animal carcasses are conventionally amputated into chunks manually, or not being amputated due to smaller sizes (e.g., sheep and dogs, etc.) by using amputating equipment such as cutting tools, amputating benches and hoists; the carcass chunks are then manually put into the incinerators for subsequent incineration. Numerous types of furnaces are adopted for use in incinerators of animal carcass of the prior art with the mode of burning the animal carcass chunks being static and mass-burning during the incineration. With such a mass-burning mode of incineration, the throughput of this type of incineration treatment system is rather low, and as a result the incineration efficiency is also low, and with the prior art, the animal incinerator is not able to treat 32 M.T. in eight hours. Furthermore, the ash withdrawal after the incineration has to rely on human labor. Additionally, because of the need to treat large quantities of animal carcasses, the incineration practice of the prior art usually requires huge freezing equipment to be set up at processing plants for storing the amputated carcasses that cannot be treated in a timely manner, so as to prevent the decaying carcasses from producing a foul odor. Such design not only increases additional expenditures to the overall cost, but it also results in a waste of labor and resources.

SUMMARY OF THE INVENTION

The primary object of the present invention is to provide an automatic system of animal carcass treatment, whereby the full automatic operation mode is adopted on processes from feeding to ash withdrawal, with the solids (bones and flesh chunks) and liquids (hemoid liquid and sewage water) being treated separately to improve the efficiency of the incineration system. The sewage water is recycled for reuse after being evaporated, and the waste gas is further treated with incineration, so that the surrounding environment is not polluted by waste gas and sewage water, thus providing an animal treatment system being in compliance with environmental protection requirements.

Another object of the present invention is to provide a method for the system of animal carcass treatment comprising: feeding, conveying, dismembering, bone crushing, solid-and-liquid separation, sewage water treatment, recycling for reuse, incineration, waste gas and ash treatment.

The system of animal carcass treatment that can effect the above mentioned objects consists of a dismembering system, an incineration system, a sewage water treatment system and a waste gas treatment system, wherein the dismembering system is a closed type system comprising a storage tank, a first conveyor, a flusher, a dismembering means, a bone crusher, a second conveyor and an exhauster; the incineration system comprises a primary combustion chamber having scrubbers mounted on a conveyor, sifters and an ash withdrawer; the sewage water treatment system comprises an evaporator, a water storage tank, a filter, a water pump and a water cooling tank, wherein the evaporator has two conduits for conducting the water from the water storage tank into the evaporator and conducting the steam into the water cooling tank, a safety valve and water valve, and the water storage tank contains a water level alarm, water monitoring viewer and water supply conduit. The waste gas treatment system comprises a stack and a secondary combustion chamber. The dismembering system can automatically separate the solids (bones and flesh chunks) from the liquids (hemoid liquids and sewage water), the solids that have been separated from liquids are crushed by the bone crusher and then preheated and incinerated in the primary combustion chamber of the incineration system in order for the remains to be turned into ashes. The liquid including hemoid liquid and sewage water that is separated from solids is filtered by a filter and pumped by a water pump to the evaporator to be heated and evaporated, allowing the sewage water to turn into steam after being heated. The steam is then conducted into the water-cooling tank in order to turn into water, and the water is later conducted through a water conduit into the flusher for flushing purposes, thus completing the recycling process of the sewage water for reuse. The waste gas generated from the incineration in the primary combustion chamber under temperature of 900° C. to 1000° C. is then burned and purified by means of burning at higher temperature (1,100° C.) in the secondary combustion chamber before being exhausted.

The storage tank is for storing the animal carcasses to be treated.

The first conveyor is for conveying the carcasses to be dismembered to the dismembering means.

The second conveyor is for conveying the solids being crushed to the incineration system.

The exhauster is for sucking out the polluted air from inside the closed type dismembering system and blowing it to the primary combustion chamber for providing the appropriate amount of air for any combustion condition during the self-burning of the solids in the primary combustion chamber, thus enhancing both disinfecting and combustion processes.

The incineration system features the functionality of preheating, being capable of drying up the solids that have been crushed, thus speeding up the incineration since the solids carry no residual water content when undergoing the combustion process.

The incineration system is built with a burner and a thermo-couple in the primary combustion chamber and the secondary combustion chamber respectively.

The scrubbers are mounted on a conveyor activated by a reducer for stirring and pushing the solids that have been crushed and conveyed into the primary combustion chamber, with the conveyor carrying the solids to the preheating zone for preheating and then to the combustion zone for incineration, and finally to the sifter for the sifting purpose.

The sifters are of different dimensions and sizes to allow the remains generated from incinerating the solids on the conveyor to be sifted through, such that larger sizes of remains are kept in the chamber for further incineration, while remains incinerated into smaller sizes are sifted through, thus all the remains of different sizes are eventually burned into ashes.

The evaporator is located on top of the primary combustion chamber, and is formed by means of the high heat of the primary combustion chamber. It is for heating and evaporating the sewage water, wherein the evaporator has two conduits, a safety valve and water valve. The two conduits are for conducting the water from the water storage tank into the evaporator and conducting the steam into the water cooling tank, the safety valve being for adjusting the safety valve to let the steam out from the roof of the furnace in the event that one of the conduits is clogged, the water valve being for removing the wastes in the evaporator to prevent from malfunction by wastes, so as to ensure the safety of the evaporator.

The water storage tank is for storing the hemoid liquid and sewage water produced during the flushing and dismembering.

The filter is for filtering the particles in the sewage water, allowing the liquids to be recycled for reuse.

The water level alarm is for giving warning signals to the operator when the water reaches the warning level.

The water-monitoring viewer is for observing the wastes and density of particles in the sewage water, in order to provide fresh water in the event that the concentration reaches an excessive level.

The water supply means is for the purpose of supplying fresh water, so as to prevent the sewage water from deteriorating.

The water cooling tank is for turning the steam generated in the evaporator to be cooled down instantly into water, and for conducting it to the flusher for flushing purpose, so as to recycle the water for reuse.

BRIEF DESCRIPTION OF THE DRAWINGS

The objects and characteristics of the present invention as stated above are to be further described in detail based on the drawing to be shown below. However, it should be noted that the drawings and the preferred embodiments referred herein are merely for the purpose of detailed description, and, therefore, not to be used to confine or limit the present invention.

Illustrated in FIG. 1 is the functional block diagram of the animal treatment of the present invention.

Figure 2:
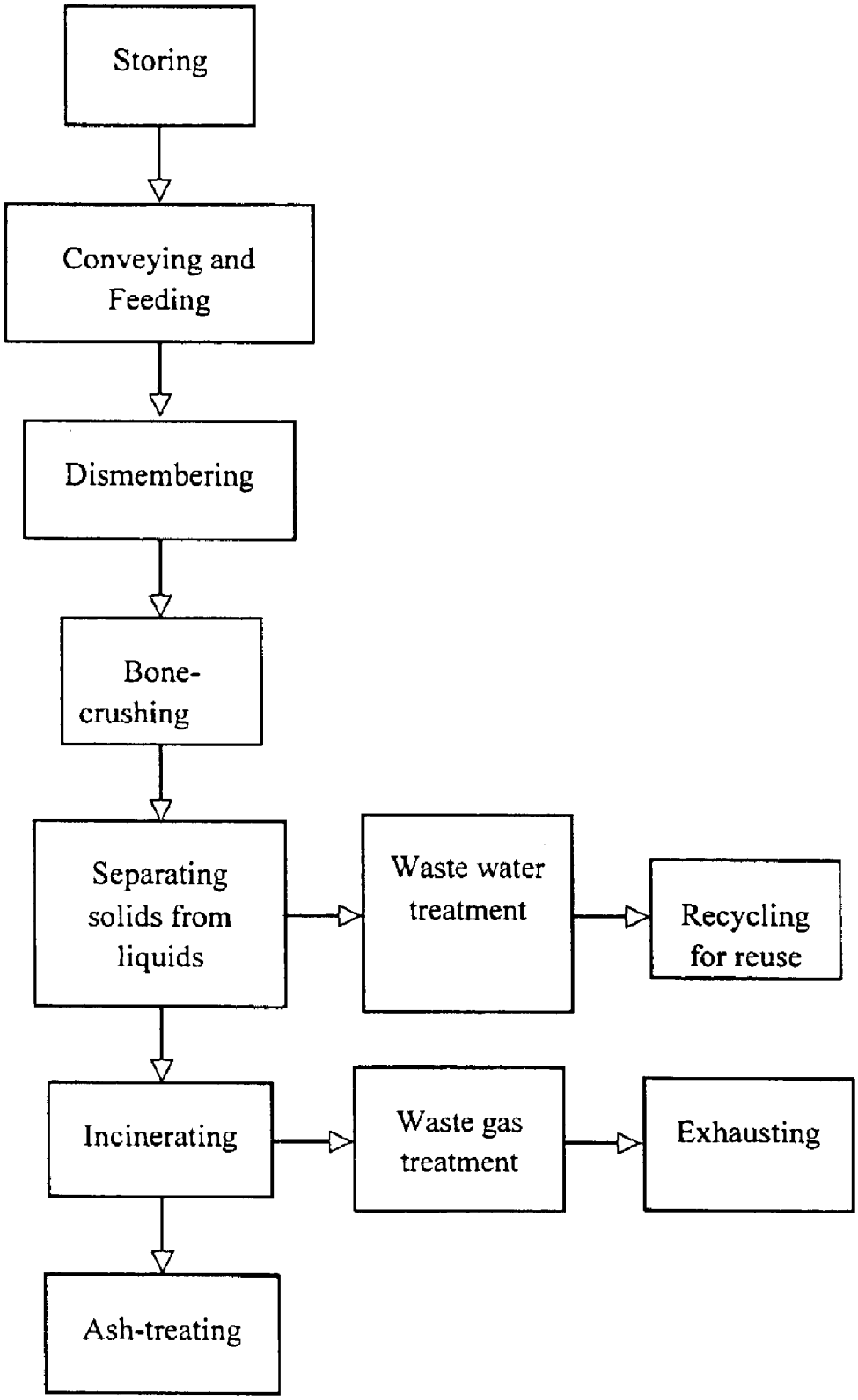

Illustrated in FIG. 2 is the flow chart of the animal treatment of the present invention.

DETAILED DESCRIPTION OF THE PREFERRED EMBODIMENT

Figure 1:
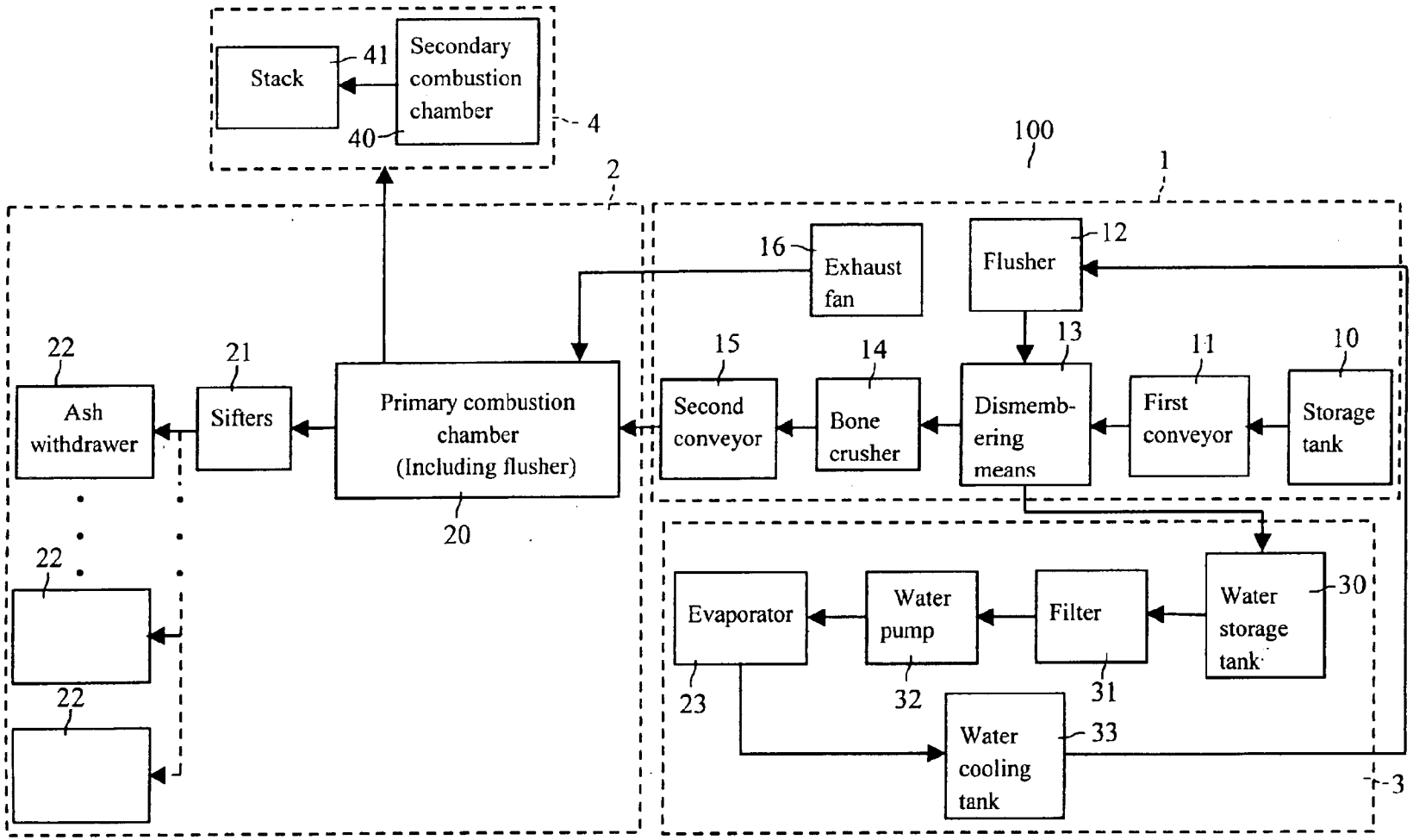
Figure 1A:
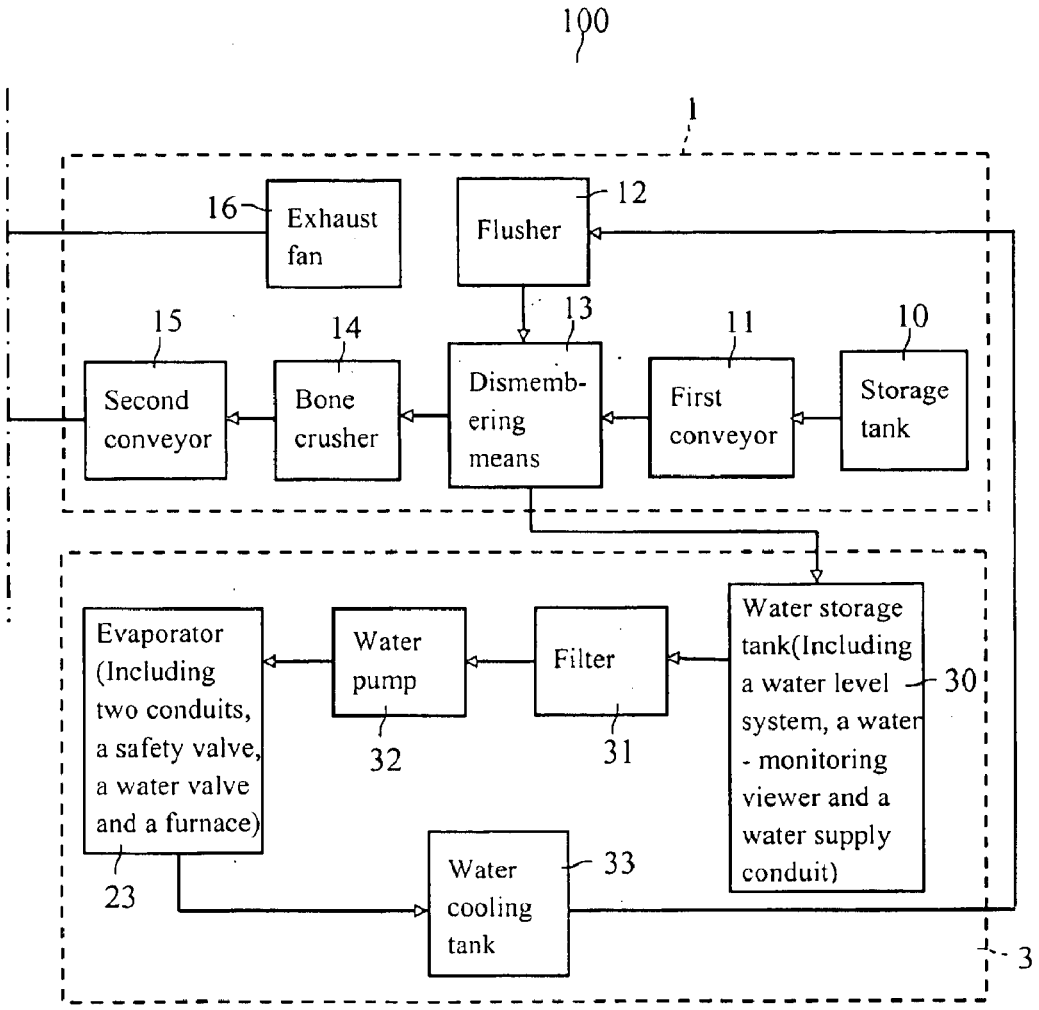
Figure 1B:
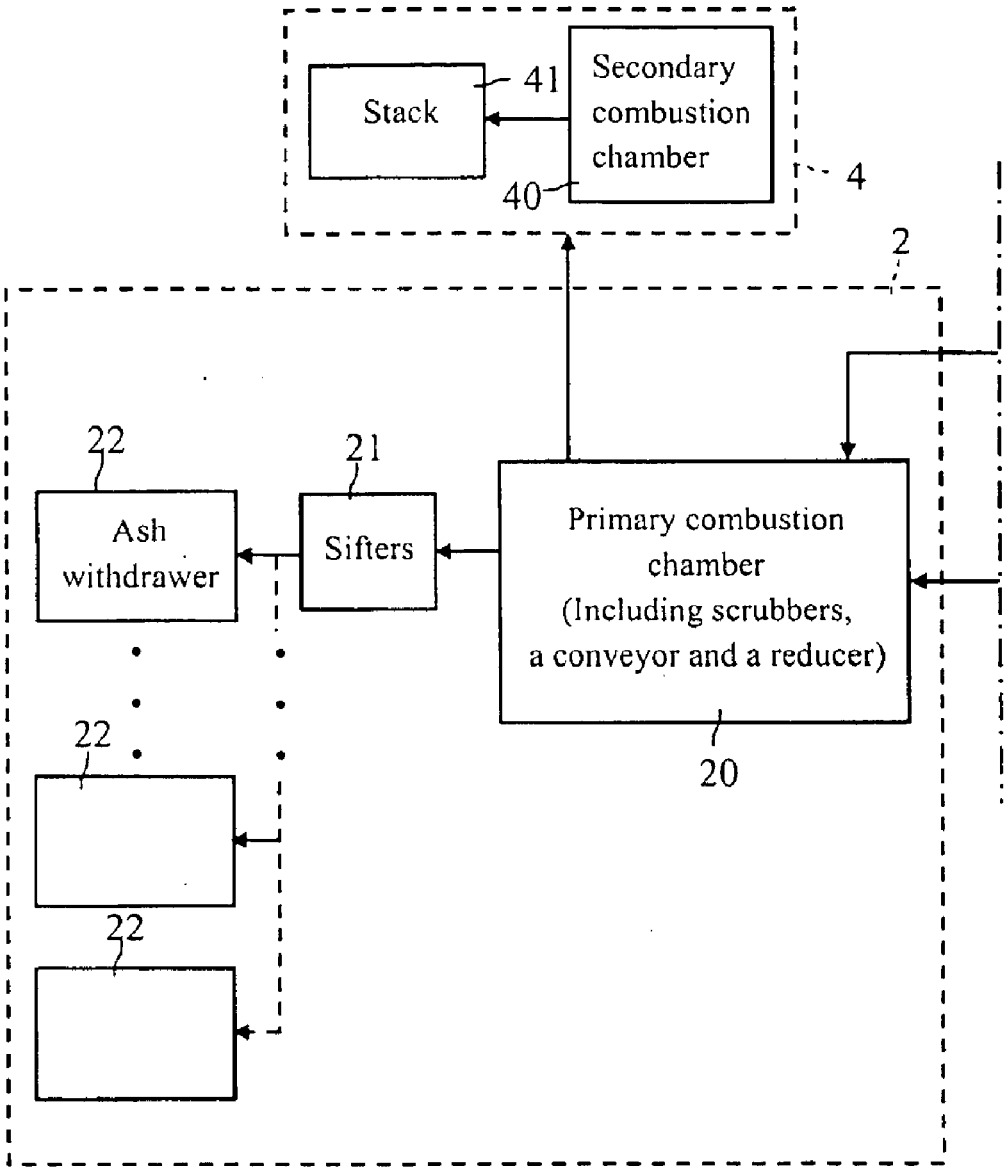

FIG. 1 is the functional block diagram for the animal treatment of the present invention, which mainly includes: a dismembering system 1, an incineration system 2, a sewage water treatment system 3 and a waste gas treatment system 4, wherein the dismembering system 1 is a closed type system, comprising a storage tank 10, a first conveyor 11, a flusher 12, a dismembering means 13, a bone crusher 14, a second conveyor 15 and an exhauster 16, wherein the storage tank 10 is for storing the animal carcass, the first conveyor 11 is for conveying the animal carcass to be dismembered to the dismembering means 13, the flusher 12 is for flushing purposes after dismembering, the bone crusher 14 is for crushing the bones after dismemberment, the second conveyor 15 is for conveying the flesh and bones that have been crushed to the incineration system 2, and the exhauster 16 is for blowing out the polluted air in the closed type dismembering system 1 to the primary combustion chamber 20 to provide the appropriate amount of air for any combustion condition during the self-burning of the solids in the primary combustion chamber, enabling the exhauster 16 to provide both disinfecting and self-burning purposes. The incineration system 2 comprises a primary combustion chamber 20 equipped with a burner, a thermocouple (not shown in drawings), sifters 21 and ash withdrawer 22 and scrubbers, wherein the primary combustion chamber 21 is divided into a preheating zone and a combustion zone, the scrubbers mounted on a conveyor activated by a reducer are capable of stirring and pushing the crushed solids, allowing the solids to be preheated in the preheating zone before being pushed into the combustion zone for incineration, and finally to the sifters 21 for sifting. The sifters 21 are of different dimensions and sizes for allowing the remains generated from incinerating the solids on the conveyor to be sifted through, such that larger sizes of remains are kept burning, while remains incinerated into smaller sizes are sifted through, thus all the remains of different sizes are eventually burned into ashes and are conveyed to the ash withdrawer 22.

The sewage water treatment system 3 comprises an evaporator, a water storage tank 30, a filter 31, a water pump 32, and a water cooling tank 33, wherein the evaporator 23, located on top of the primary combustion chamber 20, is formed by means of the high heat of the primary combustion chamber, and is for heating and evaporating the sewage water. The evaporator 23 is equipped with two conduits, a safety valve, and a water valve, the two conduits being for conducting the water from the water storage tank into the evaporator and conducting the steam into the water cooling tank 33, and the safety valve being for adjusting the safety valve for letting out the steam from the roof of the furnace in case of clogging of one of the conduits, the water valve being for removing the wastes in the evaporator 23 for preventing the evaporator 23 from malfunction caused by wastes, so as to ensure the safety of the evaporator 23. The water storage tank 30 contains a water level alarm, a water-monitoring viewer and a water supply conduit, the water storage tank 30 being for storing the hemoid liquid and sewage water generated from the flushing and dismembering, while the water level alarm is for giving warning signals to the operator in the event that water reaches the warning level, the water monitor viewer being for observing the density of particles in the sewage water such that fresh water is supplied in the event that such density becomes excessively high, the water supply means being for supplying fresh water to the water storage tank 30 when some part of the sewage water is conducted into the evaporator 23, so as to prevent the sewage water from further self-befouling, the filter 31 being for filtering particles in the sewage water, while allowing the filtered water to be pumped, by means of the water pump 32, to the evaporator 23 for heating and evaporating, and the steam generated from the evaporator being conducted into the water cooling tank 33, allowing the steam to make a physical change to water drops and to be pumped to the flusher 12 for flushing purpose, so that the sewage water is continuously recycled for reuse.

The waste gas treatment system 4 comprises a stack 41 and the secondary combustion chamber 40 which contains a burner and a thermo-couple (not shown in drawings), wherein the stack 41 is for exhausting the non-toxic gas generated from solids burned in the primary combustion chamber 20, and the secondary combustion chamber 40 provides combustion of all the resulting gas passed over from the primary combustion chamber 20.

Please see FIG. 1 for further reference on the description on the overall operation of the animal treatment system 100. First of all, a large quantity of animal carcasses are stored in the storage tank 10, then, by means of the first conveyor 11, the animal carcasses are conveyed to the dismembering means 13, and further crushed by the bone crusher 14, so that the carcasses are automatically crushed into small chunks. For example, a full-grown cow can be dismembered into 4" wide and 8" long pieces in three minutes. In the meantime the hemoid liquid and sewage water are conducted through the conduit into the water storage tank 30, while the solids, after the bone crushing process, are conveyed by the second conveyor 15 into the incineration system 2.

By the time the solids that have been crushed reach the primary combustion chamber 20 by means of the second conveyor 15, the solids are preheated prior to the actual incineration.

In the above-mentioned incineration process, by means of the scrubbers in the primary combustion chamber 20 stirring and pushing the animal carcass, the solids are preheated in order to dry quickly, and the preheated solids are continuously pushed from the preheating zone into the combustion zone of the primary combustion chamber 20 for incineration, thus forming a continuous and dynamic mode of incineration, while the remains further go through the sifters 21 of different sizes till they all turn into ashes falling in the ash withdrawer 22; the ash withdrawer 22, once full, will turn to the next ash withdrawer automatically. The waste gas generated from the burning of the primary combustion chamber 20 (at 900° C.–1,000° C.) is to be burned at higher temperature (1,100° C.) in the secondary combustion chamber 40 till the waste gas is completely burned into non-toxic gas, and later exhausted from the stack 41. The hemoid liquid and polluted water in the water storage tank 30 is then filtered by a filter 31 and pumped by a water pump 32 to the evaporator 23 after heating and evaporating, and conducted to the water cooling tank 33, allowing the steam to turn into water when cooled. It is finally pumped to the flusher 12 for flushing purpose.

Please refer to FIG. 2 regarding the method of animal treatment system of the present invention; the flow chart of the system can be divided into the following procedures:

1. storing; being storing the animal carcasses in the storage tank 10;
2. conveying and feeding continuously; being conveying and feeding automatically the animal carcasses to be treated by the dismembering means 13;
3. dismembering; being amputating animal carcasses into chunks of solids by means of the dismembering means 13;
4. bone crushing; being crushing the solids that have been dismembered;
5. solid-and-liquid separation; being conveying the solids that have been crushed through the second conveyor 15 to the incineration system 2, while conducting the hemoid liquid and sewage water to the water storage tank 30;
6. recycling for reuse; being filtering the hemoid liquid and sewage water in the water storage tank 30 by means of the filter 31, then further pumping it from the water storage tank 30 to the evaporator 23 for heating and evaporating, then conducting the steam to the water cooling tank 33 to make the physical change into water for flushing purpose.
7. incinerating; the solids being conveyed into the primary combustion chamber 20 for preheating and pushed by the scrubber into the combustion zone for incinerating, the remains being sifted according to different sizes till the remains all turn into ashes, via the means of keeping those remains failing to go through the sifters 21 due to being of larger sizes or being incompletely incinerated to be kept burning till going through the sifters 21, and the waste gas generated in the primary combustion chamber 20 is conducted into the secondary combustion chamber 40 for the purification purpose;
8. exhausting, the waste gas generated from being burned in the primary combustion chamber 20 at 900° C.–1,000° C. being further burned at higher temperature (1,100° C.) in the secondary combustion chamber 40, so as to allow the waste gas to be completely burned into non-hazardous gas prior to being exhausted from the stack 41; and
9. ash-treating; the incinerator being equipped with an automatic withdrawal of the resulting ash.

The above-mentioned feeding is a continuous mode of feeding, while the means of incineration is distributed with continuous and dynamic mode of incineration so as to burn the solids completely into ashes, thus making the whole process automatic, and making large quantity of processing possible.

Surely the present invention is not to be strictly limited to the implementation procedures as illustrated in FIG. 2 mentioned above, and the process sequence, therefore, can be modified depending on actual needs.

What is claimed is:

1. An animal treatment system comprising:

a dismembering system for amputating the carcasses of animals;

an incineration system for preheating and incinerating dismembered solids;

a sewage water treatment system for heating and evaporating liquids including hemoid liquids and sewage water generated from said dismembering system; and a waste gas treatment system for burning the resulting gas passed over from said incineration system, such that the waste gas being disinfected and purified through burning prior to being exhausted;

wherein said dismembering system is automatically capable of separating the solids from the liquids, thus improving incineration efficiency, and recycling the waste water by said sewage water treatment system for reuse, while said waste gas treatment system turns the waste gas into non-toxic gas through further incineration for preventing the waste water or waste gas from polluting the air in the surrounding environment.

2. The animal treatment system as claimed in claim 1, wherein said dismembering system includes:

a storage tank for storing the animal carcasses to be treated;

a dismembering means for performing the dismemberment;

a first conveyor for conveying the animal carcasses to be treated to said dismembering means;

a flusher for flushing said dismembering means after dismemberment;

a bone crusher for crushing the solids after dismemberment;

a second conveyor for conveying the crushed solids to said incineration system; and an exhauster for sucking out polluted air from inside said dismembering system to said incineration system for the purpose of providing the appropriate amount of air for any combustion condition during the self-burning of the solids in said primary combustion chamber, thus providing both disinfecting and combustion purposes as well.

3. The animal treatment system as claimed in claim 1, wherein said incineration system includes:

a primary combustion chamber having a plurality of scrubbers mounted on a conveyor activated by a chain reducer;

sifters of different dimensions and sizes to allow the remains generated from the incinerating of the solids in said primary combustion chamber to be sifted through, such that larger sizes of remains are kept burning into smaller sizes for being sifted through, thus all the remains of different sizes are eventually burned into ashes; and an ash withdrawer for collecting the ashes of the sifted remains, and said ash withdrawer being an automatic withdrawal of resulting ashes.

4. The animal treatment system as claimed in claim 3, wherein said sewage water treatment system includes an evaporator, a water storage tank, a filter, a water pump and a water cooling tank, said evaporator is mounted on top of said primary combustion chamber and is formed via high heat of the primary combustion chamber, for heating and evaporating the sewage water; said water storage tank is used for storing the hemoid liquid and sewage water resulted during the flushing and dismembering; said filter is used for filtering the particles in the sewage water; said water pump is used for pumping the water that has been filtered to said evaporator on said primary combustion chamber for heating and evaporating; and said water cooling tank for turning the steam generated in said evaporator into water, and for conducting it to a flusher for flushing purposes, so as to recycle the water for reuse.

5. The animal treatment system as claimed in claim 4, wherein said storage tank of said sewage water treatment system is further equipped with a water level alarm, a water monitoring viewer and a water conduit.

6. The animal treatment system as claimed in claim 3, wherein said waste gas treatment system includes:

a secondary combustion chamber for burning, at higher temperature, all the resulting gas passed over from said primary combustion chamber of said incineration system.

7. A method for animal treatment systems comprising:

dismembering, whereby animal carcasses are automatically amputated into dismembered solids and liquids including hemoid liquid and sewage water;

solid-and-liquid separation, whereby the dismembered solids are automatically separated from the hemoid liquid and sewage water;

recycling for reuse, whereby the liquid comprising said hemoid liquid and sewage water is filtered and pumped toan evaporator to be heated and evaporated, while steam is cooled down in a cooling tank and turned into water for recycling purpose;

incineration, whereby said solids are preheated, then incinerated, and said waste gas is purified by high temperature;

exhaustion, whereby said waste gas is burned and purified at a higher temperature (1,100° C.), so as for the waste gas to be completely burned into non-toxic gas prior to exhaustion; and ash treatment, whereby incinerated remains are turned into ashes and automatically collected into an ash withdrawers.

8. The method for animal treatment systems as claimed in claim 7, wherein said incineration procedure further includes sifting the incinerated remains until all remains are turned into ashes.

9. The method for animal treatment systems as claimed in claim 7, wherein the method further includes the procedure of bone crushing for crushing the dismembered solids.

10. The method for animal treatment systems as claimed in claim 9, wherein the method further includes a feed step is of automatic and continuous feeding.

11. The method for animal treatment systems as claimed in claim 9, wherein said incineration step is continuously-distributing, automatically sifting and dynamic burning.

* * * * *